US006086973A

United States Patent [19]

Hazes

[11] Patent Number: 6,086,973

[45] Date of Patent: Jul. 11, 2000

[54] ADHESIVE FILM STRIP COMPOSITE AND ITS USE

[75] Inventor: Hans Hazes, Amsterdam, Netherlands

[73] Assignee: Beiersdorf AG, Hamburg, Germany

[21] Appl. No.: 09/098,480

[22] Filed: Jun. 16, 1998

[30] Foreign Application Priority Data

Jun. 21, 1997 [DE] Germany ..... 197 26 375

[51] Int. Cl.[7] ..... B32B 9/00

[52] U.S. Cl. ..... 428/40.1; 24/306; 24/442; 24/447; 24/448; 428/41.7; 428/41.8; 428/99; 428/100

[58] Field of Search ..... 428/40.1, 41.7, 428/41.8, 99, 100; 24/442, 306, 448, 447

[56] References Cited

U.S. PATENT DOCUMENTS 5,409,189 4/1995 Lühmann ..... 248/205.3

FOREIGN PATENT DOCUMENTS

| | | |
|---|---|---|
| 141865 | 5/1985 | European Pat. Off. . |
| 42 33 872 | 3/1994 | Germany . |
| 195 11 288 | 10/1996 | Germany . |
| WO 95/35056 | 12/1995 | WIPO . |

OTHER PUBLICATIONS

Abstract of E.P. 141,865, May 22, 1985.

*Primary Examiner*—Nasser Ahmad
*Attorney, Agent, or Firm*—Norris, McLaughlin & Marcus, P.A.

[57] ABSTRACT

Adhesive film strip composite comprising a) an adhesive film strip (2) which can be released by pulling in the direction of the bond plane (B), and which b) on one of its adhesive sides is bonded to one side of a touch-and-close fastening (4,7), while c) the other side of the touch-and-close fastening (4,7) is free and can be fastened.

13 Claims, 1 Drawing Sheet

ADHESIVE FILM STRIP COMPOSITE AND ITS USE

BACKGROUND AND SUMMARY OF THE INVENTION

The invention relates to an adhesive film strip composite and to its use, namely to such a composite having a touch-and-close fastening and an adhesive film strip which is strippable by pulling in the direction of the bond plane.

Adhesive films which are rereleasable by pulling in the bond plane are known and are obtainable commercially as, for instance, "Power Strips"® from Beiersdorf AG.

Thus U.S. Pat. No. 4,024,312 describes a self-adhesive tape having an extensible and elastic backing comprising a block copolymer, especially for applications in the medical field, where painless removal from the skin is desired.

Furthermore, DE 33 31 016 A1 describes an adhesive film for releasable adhesive bonds which allows an adhesive bond produced therewith to be released by pulling on the adhesive film in the direction of the bond plane. Using such adhesive films it is possible to obtain high bond strengths and shear strengths and to release adhesive bonds again without further auxiliary means, comparable with the opening of a preserving jar, similar to the way in which the rubber seal of such a jar is pulled out of the sealing joint by the grip tab.

DE 37 14 453 C1, furthermore, describes a practice explosive which can be removed again without destruction from practice objects and which is reversibly fixed using an adhesive film.

WO 92111333 also describes, inter alia, adhesive films for corresponding applications, where the adhesive films employed combine low elasticity with high extension.

DE 42 22 849 C1 likewise describes a strip of an adhesive film of this type having a specially configured grip tab.

Finally, DE 42 33 872 C2 and WO 94121157 describe rereleasable self-adhesive hooks which are likewise equipped with such adhesive films and hence are rereleasable.

Further adhesive film strips of this kind are described in WO 95/06691, DE 43 39 604 A1, DE 44 28 587 A1 and DE 44 31 914 A1, and a corresponding suspension device is described in DE 195 11 288 A1.

The adhesive systems depicted in the abovementioned documents, however, also have a number of disadvantages:

- in order to be able to remove the adhesive film from the bond joint, part of this film must protrude from this joint in the form of a grip tab. Consequently, the adhesive film is necessarily not entirely out of sight when inflexible articles are bonded; rather, the grip tab is visible, which may appear visually disadvantageous and which, when using materials which age under the effect of light, may also lead to technical problems.
- in the course of bonding it is easy for the entire adhesive film, i.e. including the grip tab, to disappear in the bond joint. This may happen in particular to an uninitiated person who fails to place a section of such an adhesive film at the edge of the substrate in such a way that a grip tab overlaps and thus protrudes from the bonded joint. When the bond is released, then, it is difficult to know what to do, and destruction of at least one of the substrates is a possible consequence.
- if the adhesive film tears in the course of the release process, and a torn section of adhesive film remains completely in the bonded joint, then separation of the bonded material without residue and without destruction of the adherends is usually no longer possible, which may cause considerable damage.

Even the suspension device described in DE 195 11 288 has disadvantages in that bonding is possible only to solid, very smooth and, in particular, planar substrates.

It thus remains an unresolved problem as to how to fasten valuable articles or articles which are to remain undamaged, and in particular should not be drilled into, to non-planar or otherwise unfavourable substrates in such a way that the fastening is reversible, occasions no damage and can be released without residue.

Accordingly, the invention relates to an adhesive film strip composite and its use, as characterized in detail in the claims.

With regard to the touch-and-close fastenings and adhesive film strips to be used, reference is made to the prior art.

The release of the bonded articles is achieved in this case by the extension of the double-sided pressure-sensitive adhesive tape. The loss of adhesion which occurs is promoted by reducing the tack of the pressure-sensitive adhesive composition, in analogy to DE 33 31 016 or DE 42 22 849, and by the reduction in the thickness of the adhesive film, caused by the extension thereof.

When using adhesive film sections having an intermediate support, particularly suitable products are those of the type specified in WO 92111333.

The possibilities of producing the regions without pressure-sensitive adhesion, for grip tabs, are multifarious. This can be carried out, for example, by rendering the pressure-sensitive adhesive composition inert by means of a non-tacky coating. Further possibilities include the laminated application of thin sheet materials such as plastics films and papers.

Suitable cover papers or release laminates are the customary release films and release papers, e.g. siliconized release films/release papers, which are commonly employed as sheetlike media giving good release with respect to pressure-sensitive adhesive compositions.

Regarding the preparation, processing and handling of the particularly preferred adhesive films, reference may be made in general to DE 33 31 016, DE 42 22 849 and WO 92111333.

In accordance with the invention, substrates can be bonded reversibly in a number of respects, namely on the one hand by way of the touch-and-close fastening and on the other hand by way of the adhesive film strip or strips.

Advantageous applications are, in particular, those involving non-planar substrates, for instance in the automotive sector, such as on the dashboard or on side trims, for instance a mobile phone. However, it is also possible to bond other rounded articles, such as vases, balls, articles of clothing, and even the human or animal body, without damage and reversibly in this way.

In this context a version which is also advantageous is one having two grip tabs on an adhesive film strip, in accordance with EP 747 027 A2.

Other difficult substrates can also be bonded successfully, reversibly and without damage, and the bond released, such as flyscreens in front of windows, carpets on difficult substrates, suitability extending to those carpets which already have a loop reverse so that it is only necessary to use the hook part of a touch-and-close fastening.

BRIEF DESCRIPTION OF THE DRAWINGS

In the text below the invention will be elucidated with reference to drawings without, however, wishing to restrict it unnecessarily. In the drawings.

DETAILED DESCRIPTION

Figure 1:
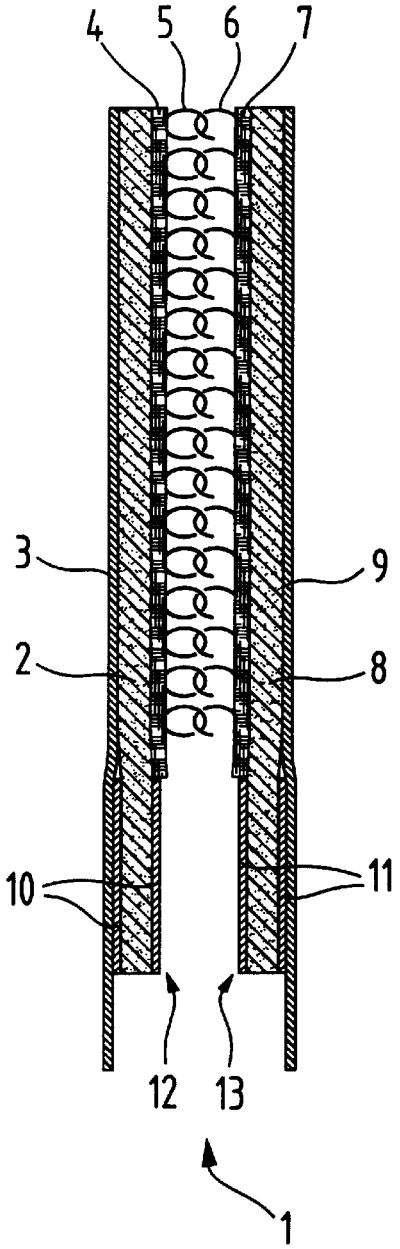
FIG. 1 shows a diagrammatic side view of a composite according to the invention.

In detail, FIG. 1 shows an adhesive film strip composite 1 comprising a first adhesive film strip 2 which is covered on one of its adhesive sides with a cover film 3, while on its other adhesive side a loop closure tape 4 is bonded such that the reverse side adjoins the adhesive film strip 2 and the front side is hooked by its loops 5 with the hooks 6 of a corresponding hooked closure tape 7. This hooked closure tape 7, in turn, is bonded by its reverse side to one of the adhesive sides of a second adhesive film strip 8, whose other adhesive side is covered in turn with a cover film 9. At their ends, the adhesive film strips 2 and 8 have regions covered with films 10/11, which regions serve as grip tabs 12/13.

Figure 2:
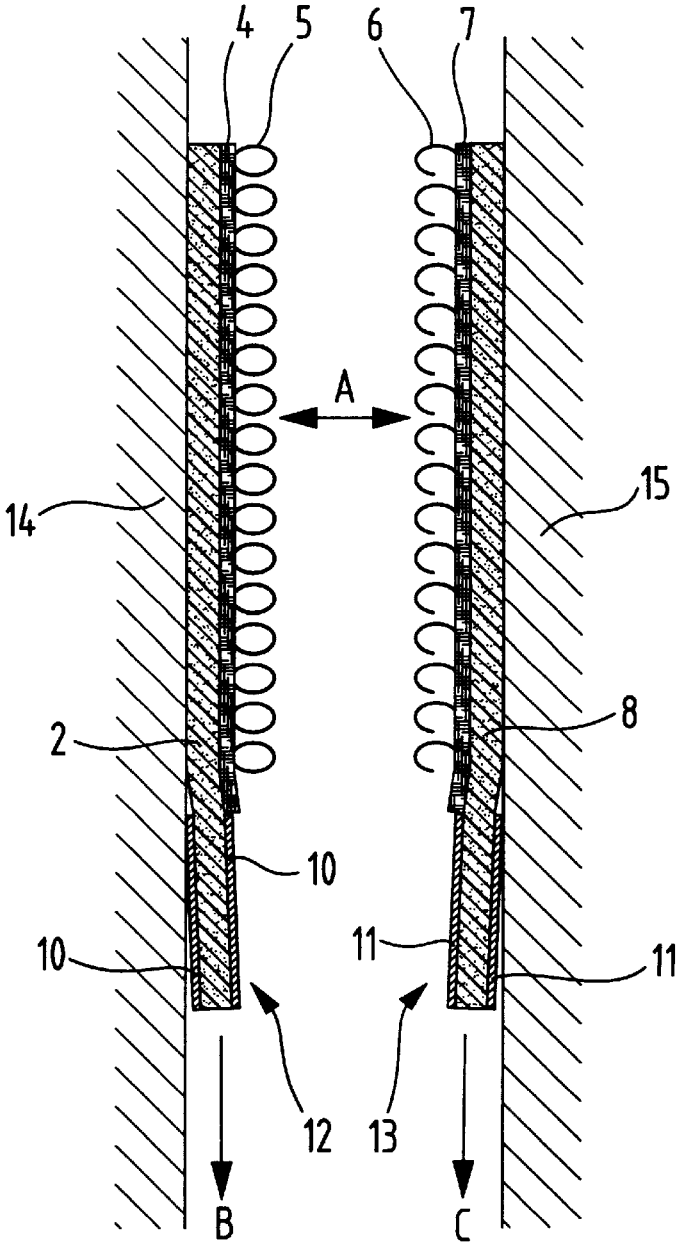
FIG. 2 shows a diagrammatic side view of a composite as in FIG. 1, bonded to substrates and pulled apart.

FIG. 2 then shows how a composite 1 as in FIG. 1, freed from its cover films 3/9, is bonded on one side to a substrate 14 and on the other side to a substrate 15, the touch-and-close fastening being open, in other words the hooked closure tape 7 being removed from the loop closure tape 4, so that the loops 5 and the hooks 6 are free and the substrates 14 and 15, with the composite parts adhering thereto, are free from one another, but yet can be joined again in the direction of the double arrow A. However, in order to free the substrates 14 and 15, respectively, from the composite section (for this purpose the composite is advantageously released in the manner of FIG. 2), the adhesive film strips 2 and 8 can be removed without damage or residue by pulling on the grip tabs 12 and 13 in the direction of the arrows A and C, i.e. in the direction of the bond plane, and at least the touch-and-close fastenings 4 and 8 can be reused. The adhesive film strip exhibits an adhesion less than its cohesion, wherein the adhesion disappears on extension, and which exhibits a ration of stripping force to tear load of least 1:1.5.

What is claimed is:

1. An adhesive film strip composite comprising:

a) an adhesive film strip which is elastically or plastically extensible, exhibits an adhesion less than its cohesion and the adhesion disappears on extension, and which exhibits a ratio of stripping force to tear load of at least 1:1.5, which when bonded to a substrate, can be released from said substrate by pulling on the adhesive film strip in the direction of the plane of the bond formed between said adhesive film strip and said substrate; and b) a plurality of hook or loop fasteners adhered to one side of said adhesive film strip in such a way that said hook or loop fasteners are free to be fastened to mating loop or hook fasteners.

2. The adhesive film strip composite according to claim 1, wherein the adhesive film strip is covered with a cover film on a side opposite that to which said plurality of hook or loop fasteners are adhered.

3. The adhesive film strip composite according to claim 1, wherein the adhesive film strip comprises a grip tab.

4. The adhesive film strip composite according to claim 3, wherein the grip tab protrudes beyond the hook or loop fasteners.

5. The adhesive film strip composite according to claim 1, wherein the adhesive film strip is elastically or plastically extensible due to the presence of an intermediate support.

6. The adhesive film strip composite according to claim 1, wherein said hook or loop fasteners are fastened to a plurality of mating loop or hook fasteners, which mating loop or hook fasteners are adhered to one side of a second adhesive film strip, which second adhesive film strip which is elastically or plastically extensible, exhibits an adhesion less than its cohesion and the adhesion disappears on extensioin, and which exhibits a ration of stripping force to tear load of at least 1:1.5, when bonded to a second substrate, can be released from said second substrate by pulling on the second adhesive film strip in the direction of the plane of the bond formed between said second adhesive film strip and said second substrate.

7. The adhesive film strip composite according to claim 6, wherein the adhesive film strip is covered with a cover film on a side opposite that to which said plurality of hook or loop fasteners are adhered, and/or the second adhesive film strip is covered with a cover film on a side opposite that to which said plurality of mating loop or hook fasteners are adhered.

8. The adhesive film strip composite according to claim 6, wherein the adhesive film strip comprises a grip tab, and/or the second adhesive film strip comprises a grip tab.

9. The adhesive film strip composite according to claim 8, wherein the grip tab of the adhesive film strip protrudes beyond the hook or loop fasteners, and/or the grip tab of the second adhesive film strip protrudes beyond the mating loop or hook fasteners.

10. The adhesive film strip composite according to claim 6, wherein the adhesive film strip and/or the second adhesive film strip is elastically or plastically extensible due to the presence of an intermediate support.

11. In a method comprising bonding an adhesive film strip to a substrate, and optionally thereafter releasing said adhesive strip from said substrate by pulling on the adhesive film strip in the direction of the plane of the bond formed between said adhesive film strip and said substrate, the improvement which comprises employing as said adhesive film strip the adhesive film strip according to any one of claims 1–4, 5, 6–9 and 10.

12. The method according to claim 11, wherein the substrate is non-planar.

13. The method according to claim 12, wherein the non-planar substrate is convex.

* * * * *